US011939838B2

(12) United States Patent
Gray

(10) Patent No.: US 11,939,838 B2
(45) Date of Patent: Mar. 26, 2024

(54) INGRESS-BARRIER ASSEMBLY FOR USE WITH PRESSURE-OPERATED DOWNHOLE EQUIPMENT

(71) Applicant: HALLIBURTON ENERGY SERVICES, INC., Houston, TX (US)

(72) Inventor: Matthew Scott Gray, London (GB)

(73) Assignee: Halliburton Energy Services, Inc., Houston, TX (US)

( * ) Notice: Subject to any disclaimer, the term of this patent is extended or adjusted under 35 U.S.C. 154(b) by 791 days.

(21) Appl. No.: 16/966,067

(22) PCT Filed: Dec. 5, 2019

(86) PCT No.: PCT/US2019/064756

§ 371 (c)(1),
(2) Date: Jul. 30, 2020

(87) PCT Pub. No.: WO2021/112864

PCT Pub. Date: Jun. 10, 2021

(65) Prior Publication Data

US 2023/0175352 A1 Jun. 8, 2023

(51) Int. Cl.

| | |
|---|---|
| ***E21B 23/04*** | (2006.01) |
| ***E21B 34/10*** | (2006.01) |
| ***E21B 34/16*** | (2006.01) |

(52) U.S. Cl.
CPC ..... *E21B 34/10* (2013.01); *E21B 23/04* (2013.01); *E21B 34/16* (2013.01)

(58) Field of Classification Search
CPC ..... E21B 23/04
See application file for complete search history.

(56) References Cited

U.S. PATENT DOCUMENTS

| | | | | |
|---|---|---|---|---|
| 4,202,368 | A * | 5/1980 | Akkerman | E21B 34/16 137/498 |
| 4,422,503 | A * | 12/1983 | Goans | E21B 34/16 91/394 |
| 6,595,296 | B1 | 7/2003 | French et al. | |
| 9,874,072 | B2 * | 1/2018 | Clement | E21B 34/14 |
| 11,125,346 | B2 * | 9/2021 | Cilli | E21B 17/023 |

(Continued)

FOREIGN PATENT DOCUMENTS

| | | |
|---|---|---|
| WO | 2016137440 | 9/2016 |

OTHER PUBLICATIONS

PCT Application No. PCT/US2019/064756, International Search Report and Written Opinion, dated Aug. 31, 2020, 12 pages.

*Primary Examiner* — Matthew R Buck
(74) *Attorney, Agent, or Firm* — Kilpatrick Townsend & Stockton LLP

(57) ABSTRACT

An ingress-barrier assembly for use with pressure-operated downhole equipment can be used to limit hydraulic fluid flow in a wellbore environment for completions and operations through the life of a well. An assembly can comprise a first port to communicate hydraulic fluid with a first fluid conveyance line. The assembly can include a second port to communicate hydraulic fluid with a second fluid conveyance line. The assembly can further include a first-end stop, a second-end stop, and a moveable seal. The moveable seal can move within a bore of the assembly between the first-end stop and the second-end stop to communicate pressure between the first port and the second port.

24 Claims, 4 Drawing Sheets

(56) References Cited

U.S. PATENT DOCUMENTS

| | | | | |
|---|---|---|---|---|
| 2004/0050555 | A1* | 3/2004 | Rayssiguier | E21B 34/16<br>166/374 |
| 2005/0274528 | A1* | 12/2005 | Hiron | E21B 34/10<br>166/87.1 |
| 2009/0218102 | A1 | 9/2009 | Casciaro | |

* cited by examiner

INGRESS-BARRIER ASSEMBLY FOR USE WITH PRESSURE-OPERATED DOWNHOLE EQUIPMENT

TECHNICAL FIELD

The present disclosure relates to devices usable to operate equipment in a wellbore environment for completions and operations through the life of a well. More specifically, this disclosure relates to an ingress-barrier assembly, for use with pressure-operated downhole equipment, to limit hydraulic fluid flow in a wellbore environment.

BACKGROUND

Hydrocarbons can be present within a wellbore environment during well completion and operations phases. Hydrocarbons can travel uphole and contact various downhole equipment and subassemblies. Well conditions and equipment operations may cause damage to downhole equipment. A control line is a small-diameter hydraulic line used to operate downhole completion equipment. Control lines can be used to provide a predetermined path for fluids from downhole equipment to the surface of the well and vice versa so that pressurized hydrocarbons remain isolated within the wellbore environment (e.g., if the isolated flow path is jeopardized, pressurized hydrocarbons can escape to the surface via the control lines).

DETAILED DESCRIPTION

Figure 1:
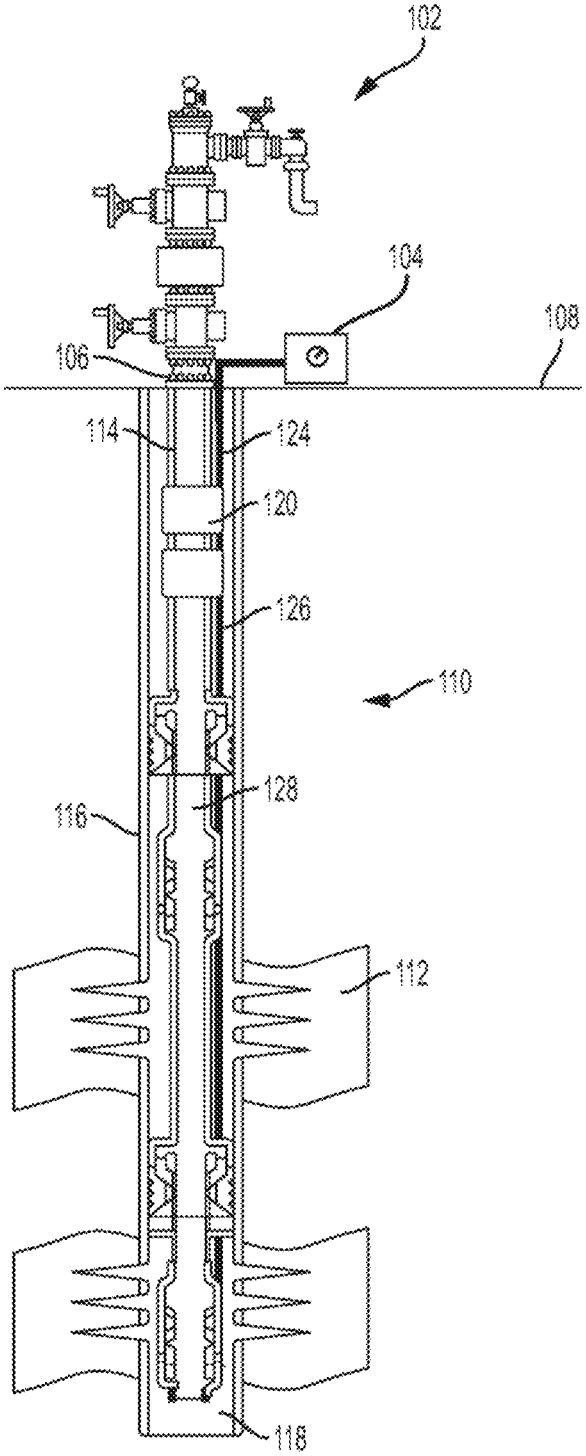
FIG. 1 is a cross-sectional view of an example of a wellbore completion and operation environment according to some aspects of the present disclosure.

Certain aspects and features relate to an ingress-barrier assembly, for use with pressure-operated downhole equipment, to limit hydraulic fluid flow in the well completion and operations phases. Ingress-barriers within the isolated fluid flow path can prevent hydrocarbon leaks out of a well. An ingress-barrier assembly can be mounted into the isolated fluid flow path between the downhole pressure-operated equipment and the pressure management source outside of the wellbore. For example, an ingress-barrier assembly can be mounted onto the completion tubing string and plumbed in line with a control line. The ingress-barrier can have an internal chamber to couple a bottom portion of a control line with a top portion of a control line such that the chamber can act as an intermediary component in which fluid can flow. The internal chamber of the ingress-barrier can include a moveable seal (e.g., pistons) to stop the uphole migration of unintended fluids (e.g., hydrocarbons). During normal operation, the moveable seal can move along the length of the internal chamber to allow fluid movement and pressure transmission along the control line. When unintended fluids are released into the control lines, pressure can be created, which can force the moveable seal to move a fixed amount until the moveable seal stops at the end of the internal chamber. The seal provided by the moveable seal can prevent released unintended fluids from traversing further up the isolated flow path.

The moveable seal can be passive, causing minimal or no functional change to the well operating system or downhole equipment. In the event the isolated flow path is breached, the ingress barrier assembly can stop the uncontrolled flow of fluid up the control line. The pressure from the breach can cause the moveable seal to move within the internal chamber of the ingress barrier assembly until the moveable seal is stopped at the end of the internal chamber of the ingress-barrier, stopping further fluid flow within the isolated flow path. The ingress-barrier via moveable seal in the internal chamber can act as an automatic stop when faced with hydraulic pressure within the wellbore environment.

In some examples, the ingress-barrier can implement a reset function to return the moveable seal to a neutral position (e.g., the moveable seal is not in contact with either end of the internal chamber) within the internal chamber, so that the moveable seal does not gradually drift out of a functional movement range. A reset function can prevent the moveable seal from permanently closing off one end of the internal chamber due to the position of the movable seal. The reset function can include a bypass element that equalizes the pressures on both sides of the moveable seal, such that pressure to the moveable seal is no longer being applied with enough force to position the movable seal at one end of the internal chamber. The internal chamber can have reset elements (e.g., springs) to force the moveable seal back into a neutral position.

In some examples, the movable seal of the ingress-barrier can engage an additional seal point at the ends of the internal chamber. When unintended fluids have entered the isolated flow path, and have moved the movable seal to one end of the internal chamber, the movable seal can engage an additional sealing point to offer secondary point of isolation within the isolated flow path. The additional sealing point of the ingress-barrier internal chamber can act as an automatic stop to engage a secondary seal when faced with hydraulic pressure within the wellbore environment.

Traditional control-line flow barriers can be controlled by subsea control systems or control systems located at the surface of a wellbore. Commonly, a barrier to fluid flow within an isolated flow path for downhole equipment controls can be provided by individually closing each of the control lines at the surface of the well with a shut-in valve. When pressure into or out of the control lines is required, the shut-in valves can involve an input or manual intervention to be opened. But, when the shut-in valves are opened, no barrier to fluid flow exists within the isolated flow path. This can be problematic since these shut-in valves are often left in an open state during traditional operating conditions. Additionally, shut-in valves can prevent pressures from balancing within the control lines due to the limited functionality of the shut-in valves. The lack of ability to balance pressure within the control lines can prevent normal operations of control line-operated equipment.

Implementing an ingress-barrier assembly with passive moveable seals can provide for a control-line barrier that does not require systems or wellbore operators to perform additional operations for control-line functions at the surface of the wellbore environment. Eliminating the need for additional systems or operators can improve efficiency of well completions and operations phases and reduce overall cost. The ingress-barrier assembly can allow for the necessary balancing of fluid between different control lines while maintaining a constant barrier requiring no operational oversight. By providing a methodology to manage fluid control automatically, operations can be further streamlined, avoiding costs resulting from mishandled hydrocarbon breaches. An ingress-barrier assembly can provide additional benefit by acting as a passive debris barrier, preventing particles above the ingress-barrier assembly from traveling down a well assembly to other assemblies and downhole equipment. The ingress-barrier assembly may further be used as a failsafe system in the event of control separation between the downhole equipment and the pressure application source on the top side of the well.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a cross-sectional view of a wellbore completion and operation environment 102 that includes a wellbore completion assembly 114 according to one example. The well completion and operation environment 102 can include a well 110 extending through various earth strata. The well 110 can extend through a hydrocarbon-bearing subterranean formation 112. The wellbore completion assembly 114 can be positioned at the surface 108 or otherwise arranged within the well 110. The well completion assembly 114 may be used in other environments, such as subsea environments, and may include any tools necessary to implement conventional methods of subsea completion and operations. The wellbore completion and operation environment 102 can include a pressure management source 104 positioned outside of the well 110 at the surface 108. The pressure management source 104 can communicate fluid from within the well 110 via a wellhead 106. The pressure management source 104 can control pressures within the well 110. Further, the pressure management source 104 can be connected to the fluid conveyance line 124. The pressure management source 104 can include any pressure control and measurements tools and devices, such as a pressure gauge, to measure or control pressure within the fluid conveyance line 124.

The well completion assembly 114 can include various components to control hydraulic fluid flow in the well completion and operation environment 102. The well completion assembly 114 can include a fluid conveyance line 124, a fluid conveyance line 126, completion tubing 128, and an ingress-barrier assembly 120. The fluid conveyance line 124, fluid conveyance line 126, and ingress-barrier assembly 120 can be useable with pressure-operated downhole equipment. In some examples, the fluid conveyance line 124 and fluid conveyance line 126 can be control lines. The ingress-barrier assembly 120 can be mounted onto the completion tubing 128 and plumbed in line with the fluid conveyance line 124 and the fluid conveyance line 126 within the well 110.

The well 110 can include fluid 118. The fluid 118 can flow in an annulus positioned between the well completion assembly 114 and a production casing 116 acting as a wall of the well 110. The fluid 118 can include hydrocarbons or other similar fluids or contaminants typical of the wellbore completion and operation environment 102. The fluid 118 can enter the fluid conveyance line 126 via pressure-operated downhole equipment located near the bottom or along the well 110. The fluid 118 can enter the fluid conveyance line 124 or the fluid conveyance line 126 during a breach (e.g., the fluid conveyance line 124 or fluid conveyance line 126 is torn or cut and subject to the fluid 118). Pressure caused by the fluid 118 in the fluid conveyance line 124 or fluid conveyance line 126 can cause components of the ingress-barrier assembly 120 to prevent the fluid 118 from traversing through the ingress-barrier assembly 120. For example, a breach in the fluid conveyance line 126 can cause pressure buildup by the fluid 118, forcing the ingress-barrier 120 to close off the fluid flow pathway to the fluid conveyance line 124, preventing unwanted hydrocarbons from reaching various components of the well completion assembly 114.

In some examples, the ingress-barrier assembly 120 can be positioned in any applicable location between a pressure management source or other ventilation location and downhole equipment. For example, in a subsea completion and operation environment, the ingress-barrier assembly 120 can be placed outside of the well system (e.g., for use with a subsea "Christmas tree"). As another example, the ingress-barrier assembly 120 can be positioned deep within the well 110 below a bubble point. Placing the ingress-barrier assembly 120 below a bubble point can prevent gas, which can be located in the annulus of the well 110 with or in place of fluid 118, from bypassing sealing components of the ingress-barrier assembly 120.

In some examples, the ingress-barrier assembly 120 can be used to isolate different zones within the well 110. Pressure can be applied to the ingress-barrier assembly 120 from the surface 108 to isolate the fluid conveyance line 126 and any downhole equipment connected to fluid conveyance line 126 from the fluid conveyance line 124 (e.g., isolating components of the well completion assembly 114 extending beyond the ingress-barrier assembly 120 from the surface 108). In some examples, multiple ingress-barrier assemblies can be used to segment the well completion assembly 114 into zones that have fluid flow through fluid conveyance lines and zones that do not have fluid flow.

Figure 2:
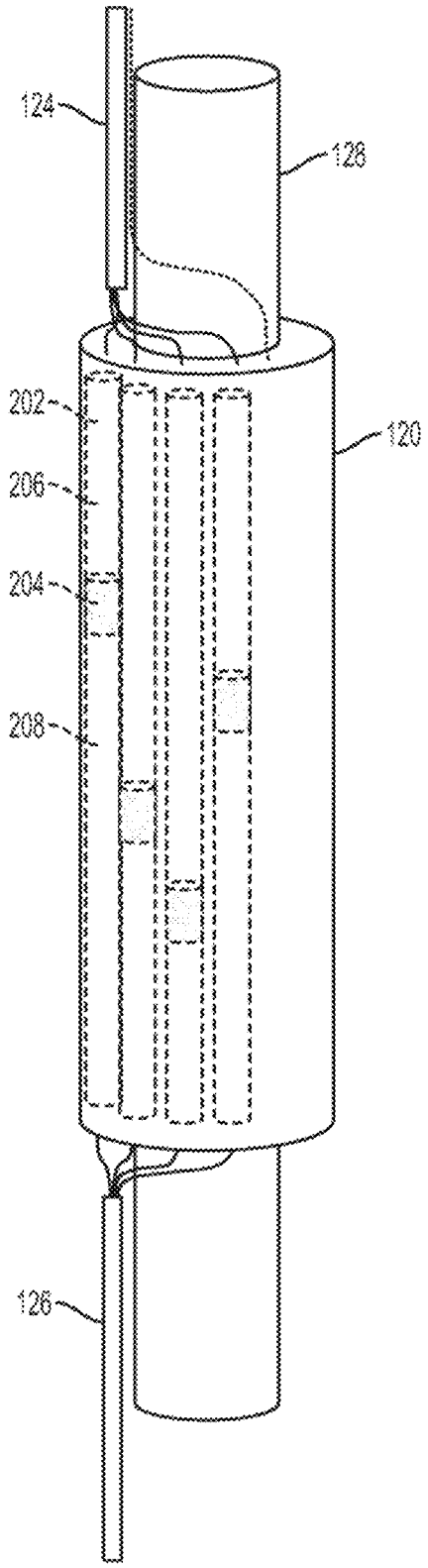
FIG. 2 is a cross-sectional view of an example of an ingress-barrier assembly according to some aspects of the present disclosure.

FIG. 2 is a cross-sectional view an ingress-barrier assembly 120 according to one example. The ingress-barrier assembly 120 can be mounted onto the completion tubing 128. The fluid conveyance line 124 and the fluid conveyance line 126 can be connected to the ingress-barrier assembly 120 through an internal chamber 202 (e.g., a bore within the ingress-barrier assembly 120). The internal chamber 202 can establish a fluid flow path between the fluid conveyance line 124 and the fluid conveyance line 126 to operate pressure-operated downhole equipment while simultaneously providing a passive pressure barrier in the event of a fluid breach.

The uphole-oriented (e.g., top) end of the internal chamber 202 can include a port to communicate hydraulic fluid into or out of the internal chamber 202 from or to the fluid conveyance line 124. The downhole-oriented (e.g., bottom) end of the internal chamber can include a port to communicate hydraulic fluid into or out of the internal chamber 202 from or to the fluid conveyance line 126. The internal chamber 202 can include a moveable seal 204 (e.g., a piston) that can travel within the internal chamber 202. The top end of the internal chamber 202 or a component located at the top end can act as an end stop for the moveable seal 204 to contact. The bottom end of the internal chamber 202 or a component located at the bottom end can act as another end stop for the moveable seal 204 to contact. The moveable seal 204 can be positioned within the internal chamber 202 between the top end stop and bottom end stop to communicate pressure between the top port and the bottom port.

When sufficient pressure is applied to the moveable seal 204, in either an uphole or a downhole fluid flow direction, the moveable seal 204 can push against an end stop of the internal chamber 202 to create a seal that prevents further flow of fluid from the internal chamber 202 to the fluid conveyance line 124 or the fluid conveyance line 126. For example, lower-pressure hydraulic fluid travelling from the surface of the wellbore environment via the fluid conveyance line 124 can enter the top port of the internal chamber 202 to provide pressure on the moveable seal 204. The moveable seal 204, in turn, provides pressure on hydraulic fluid downhole from the moveable seal 204 and through the bottom port of the internal chamber 202 to the fluid conveyance line 126. If sufficient pressure is asserted against the moveable seal 204 by the fluid travelling from the top port to the internal chamber 202, the moveable seal 204 can (i) move from its centralized location (e.g., a location within the ingress-barrier assembly that is between the top port and the bottom port) within the internal chamber 202, (ii) move towards the bottom port, and (iii) contact the bottom end stop to form a seal that prevents further fluid flow into the fluid conveyance line 126. Applying excess hydraulic pressure from the surface can be useful in controlling pressure-operated downhole equipment.

As another example, lower-pressure hydraulic fluid travelling from the bottom of the wellbore environment via the fluid conveyance line 126 can enter the bottom port of the internal chamber 202 to provide pressure on the moveable seal 204. The moveable seal 204, in turn, provides pressure on hydraulic fluid uphole from the moveable seal 204 and through the top port of the internal chamber 202 to the fluid conveyance line 124. If sufficient pressure is asserted against the moveable seal 204 by the fluid travelling from the bottom port to the internal chamber 202, the moveable seal 204 can (i) move from its centralized location between the top port and bottom port within the internal chamber 202, (ii) move towards the top port, and (iii) contact the top end stop to form a seal that prevents further fluid flow into the fluid conveyance line 124. Using a moveable seal to automatically prevent unwanted fluid (e.g., fluid characterized by excess pressure) from reaching the surface or other portions of the wellbore completion and operation assembly can help eliminate contamination risks and improve operating efficiency.

During normal operating conditions, the fluid travelling through the set of the fluid conveyance line 124, fluid conveyance line 126, and internal chamber 202 will not provide a sufficient pressure differential above and below the moveable seal 204 to cause the moveable seal 204 to form a seal at the top end stop or the bottom end stop of the internal chamber 202. Normal operating conditions can include supplying hydraulic fluid from the surface that is used to operate any downhole equipment such that the fluid supplied does not exhibit enough pressure against the moveable seal 204 to form a seal at the top end stop or the bottom end stop within the internal chamber 202. Normal operating conditions can further include removal or depressurization of fluid within the well, such that the fluid being removed from or depressurized downhole is leaked to surface in a controlled manner while limiting pressure applied to the moveable seal 204 so that a seal is not formed at the top end stop or the bottom end stop within the internal chamber 202. During operation, the moveable seal 204 can form a seal at the bottom end stop or the top end stop within the internal chamber 202 during events of downhole equipment control using excess fluid pressure from the surface or during downhole events caused by excess fluid pressure resulting from fluid conveyance line breaches (e.g., runaway fluid).

In some examples, the ingress-barrier assembly 120 can be filled with hydraulic fluid before or during installation (i.e., the internal chamber 202 is completely filled with fluid during run-in of the ingress-barrier assembly 120 into the well). The moveable seal 204 can be positioned between a hydraulic fluid 206 above the moveable seal 204 and a hydraulic fluid 208 below the moveable seal 204. When the hydraulic fluid 206 and the hydraulic fluid 208 exhibit equivalent or nearly equivalent pressures on the moveable seal 204, the moveable seal 204 can be balanced between the two pressurized fluids and not be displaced significantly. The hydraulic fluid 206 can exhibit a different pressure value than the hydraulic fluid 208 on the moveable seal 204. A disparity in pressure values of the hydraulic fluid 206 and hydraulic fluid 208 can result in the moveable seal 204 being displaced. The moveable seal 204, in response to the pressure being greater either above or below the moveable seal 204, can positively displace the lower pressure fluid and form a seal. For example, if the hydraulic fluid 208 has a pressure that is significantly greater than the pressure of the hydraulic fluid 206, the moveable seal 204 can displace the hydraulic fluid 206, pushing the hydraulic fluid 206 back into the fluid conveyance line 124. Upon reaching the top of the internal chamber 202, the moveable seal can form a seal, at which point the hydraulic fluid 206 is sealed off from the hydraulic fluid 208. After being sealed, the internal chamber 202 can be filled with a higher-pressure hydraulic fluid 208 and the moveable seal 204, such that the hydraulic fluid 206 rests within the fluid conveyance line 124 with a lower pressure value.

In some examples, the hydraulic fluid 206 or the hydraulic fluid 208 can displace the moveable seal 204 when the pressure value of either fluid is significant enough to overcome various resistive forces inside the internal chamber 202 (e.g., gravity, friction of the moveable seal 204 within the internal chamber 202, any optional physical components providing resistance used to centralize the moveable seal 204 within the internal chamber 202, etc.).

Figure 3:
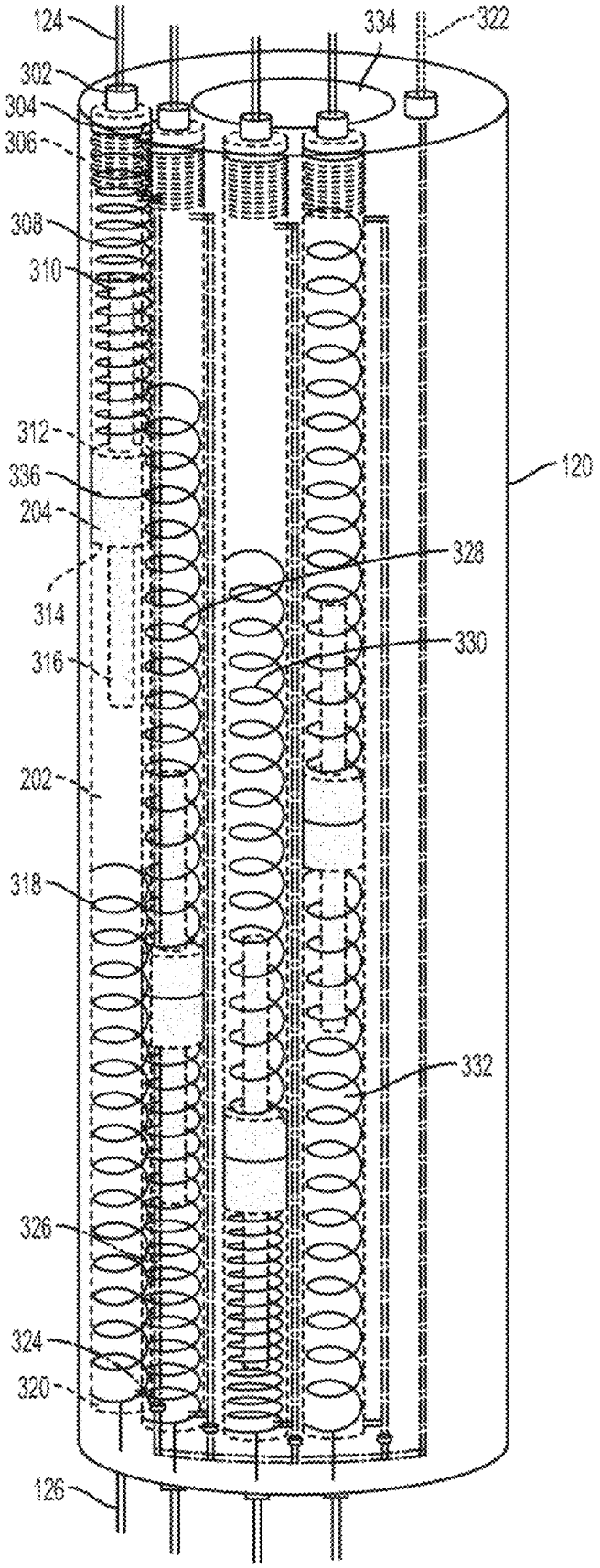
FIG. 3 is a cross-sectional view of an example of an ingress-barrier assembly with a pilot reset line according to some aspects of the present disclosure.

FIG. 3 is a cross-sectional view of an ingress-barrier assembly 120 with a pilot reset line 322 according to one example. FIG. 3 depicts a more detailed view of an example of the ingress-barrier assembly 120 further including various optional elements to improve functionality. The various optional elements can include an upper compressive element 308, a lower compressive element 318, an upper bump stop 310, a lower bump stop 316, a pilot reset line 322, a valve 324, an internal port 326, and a ring 336. The pilot reset line 322 can be used to equalize pressure above and below the moveable seal 204 in the internal chamber 202 of the ingress-barrier assembly 120.

In some examples, the ingress-barrier assembly 120 can include multiple internal chambers (e.g., internal chambers 202, 328, 330, 332) to accommodate for fluid communications with separate pressure-operated downhole equipment. The separate internal chambers 202, 328, 330, 332 can be subjected to varying pressures at any given time, such that hydraulic fluid above and below the moveable seal in one chamber exhibit different pressure values than hydraulic fluid above and below the moveable seal in another chamber. For example, the moveable seal of the internal chamber 328 can be in a sealed off configuration (e.g., the fluids above or below the moveable seal of the internal chamber 328 do not exhibit enough pressure to displace the moveable seal to form a seal). At the same instance, the moveable seal of the internal chamber 330 can be in a standby configuration or centralized position (e.g., the fluids above and below the moveable seal of the internal chamber 330 do not exhibit enough pressure to displace the moveable seal to form a seal). In the same example, the moveable seal of the internal chamber 332 can be in a displaced state, distinct from a sealed configuration or standby configuration. In the displaced state, the moveable seal can be displaced from a centralized position in response to a change in pressure, but does not fully travel to one end of the internal chamber 332 to form a seal (e.g., the pressure is not sufficient enough to overcome resistive forces). Implementation of one or more internal chambers can allow the ingress-barrier assembly 120 to operate downhole equipment requiring pressure individually. This can improve overall operating efficiency by isolating fluid conveyance lines from each other (e.g., a breach in one fluid conveyance line will not affect the operation of other fluid conveyance lines).

In some examples, the fluid conveyance line 124 and fluid conveyance line 126 can be control lines. The fluid conveyance line 124 and fluid conveyance line 126 can be flat-packed against completion tubing or other assemblies located within the wellbore environment. For examples of the ingress-barrier assembly 120 including more than one internal chamber (e.g., internal chamber 202, 328, 330, 332), more than one fluid conveyance line can be required to be run uphole and downhole from the ingress-barrier assembly 120. Flat packing the fluid conveyance line 124 and the fluid conveyance line 126 with additional adjacent fluid conveyance lines can reduce the total protrusion of the fluid conveyance lines outward from the completion tubing, reducing the risk of breach or damage to the fluid conveyance lines.

The fluid conveyance line 124 can be tacked or bolted to the ingress-barrier assembly 120 via lodging mechanism 302. The lodging mechanism 302 (e.g., nut, bolt, other conventional line sealing means) can hold the fluid conveyance line 124 (e.g., ¼ inch OD control-line hollow tube) in place to withstand conventional wellbore completion and operation pressures without leaking hydraulic fluid into the surround wellbore environment. The fluid conveyance line 126 can be tacked or bolted to the ingress-barrier assembly 120 via a similar or same lodging mechanism at the downhole end of the ingress-barrier assembly 120. The lodging mechanism 302 can provide a means for continuation of the internal fluid conduit, since the fluid conveyance line 124 and fluid conveyance line 126 terminate at the ingress-barrier assembly 120 and do not run through the internal chamber 202.

The moveable seal 204 can be a low-friction component that can include a ring 336 comprising rubber or some other elastomeric element. In some examples, the ring 336 can create a seal to prevent fluid communication between the when the moveable seal is positioned at the either end of the internal chamber 202.

In some examples, the moveable seal 204 can be a piston. The moveable seal 204 can be a material that can withstand hydraulic pressures existing within conventional wellbore completion and operation environments and can withstand corrosive effects caused by contact with fluid in a well (e.g., stainless steel). The moveable seal 204 can have an upper bump stop 310 affixed to the uphole end of the moveable seal 204 and a lower bump stop 316 affixed to the downhole end of the moveable seal 204. In some examples, the upper bump stop 310 and the lower bump stop 316 can be part of the moveable seal 204 (e.g., the moveable seal 204 is one mold of the same material that includes the upper bump stop 310 and the lower bump stop 316). In other examples, the upper bump stop 310 and the lower bump stop 316 can be a different material from the moveable seal 204 and can be permanently affixed to the moveable seal 204.

A seal 304 can be positioned within a chamber end plug 306. The chamber end plug 306 can be a threaded-piston chamber-end plug. The chamber end plug 306 can be a material similar to the moveable seal 204 that can withstand pressures and corrosive attributes of well fluids (e.g., stainless steel). The chamber end plug 306 can house the seal 304 adjacent to the lodging mechanism 302 so that the seal is flush against the top of the internal chamber 202. In other examples, the seal 304 can be built into the chamber end plug 306. The seal 304 can be a material similar to the moveable seal 204 that can withstand pressures and corrosive attributes of well fluids (e.g., stainless steel). The chamber end plug 306 can be used in manufacturing of the ingress-barrier assembly 120 for purposes of installing the moveable seal 204 within the internal chamber 202 (e.g., prior to use, the moveable seal 204 can be inserted into the internal chamber 202, then the chamber end plug 306 can be installed to seal the moveable seal 204 within the internal chamber 202).

The upper bump stop 310 and the lower bump stop 316 can be used to seal the respective ends of the internal chamber 202. When sufficient pressure forces the moveable seal 204 uphole, the upper bump stop 310 can be inserted through the inner diameter of the chamber end plug 306 to make contact with the seal 304. Pressure from below the moveable seal 204 can cause the upper bump stop 310 to form a seal with seal 304 to cease and further prevent the communication of pressure to the fluid conveyance line 124. A seal can be maintained by seal 304 and the upper bump stop 310 for a duration until the hydraulic pressure below the moveable seal 204 depressurizes (e.g., the pressure is not sufficient to hold the upper bump stop 310 against the seal 304.

The upper bump stop 310 and the seal 304 can be a metal-to-metal seal, such that both components are comprised of metal. Using metal-to-metal contacts for sealing the internal chamber 202 can increase durability of the ingress-barrier assembly 120, since metal components may not be subject to the same degradation of conventional elastomeric seals. The metal-to-metal contact provided by the upper bump stop 310 and the seal 304 can include a metal ball against which the upper bump stop 310 can push, plugging the seal 304 and preventing hydraulic fluid communication.

Embodiments using the same or similar components for providing a sealing mechanism at the bottom of the internal chamber 202 at location 320 can be implemented. The lower bump stop 316 can be inserted into a seal, which can prevent fluid flow from entering the fluid conveyance line 126 connected to the internal chamber 202 using a bolt.

In some examples, the moveable seal 204 can be repositioned within the internal chamber 202 using an upper compressive element 308 and a lower compressive element 318. The upper compressive element 308 and the lower compressive element 318 can be any mechanism that can provide sufficient force to centralize the moveable seal 204 within the internal chamber 202 while also being compressible in the face of hydraulic fluid pressure resulting in a seal (e.g., springs, elastomeric elements). The upper compressive element 308 and the lower compressive element 318 can be constructed out of material appropriate for the implemented type of compressive mechanism (e.g., for a spring, a corrosion-resistant malleable metal can be used). The diameters of the upper compressive element 308 and the lower compressive element 318 can be less than or equal to the inner diameter of the internal chamber 202.

The moveable seal 204 can remain in a centralized location in the internal chamber 202 until a threshold pressure is applied to either end of the moveable seal 204. For example, upon reaching a threshold pressure beneath the contact surface 314 of the moveable seal 204, the hydraulic pressure can overcome the resistive force provided by the upper compressible element 308. As a result, the contact surface 312 of the moveable seal 204 can be forced against the upper compressive element 308 causing it to compress until forming a seal with the seal 304. Similarly, upon reaching a threshold pressure above the contact surface 312 of the moveable seal 204, the hydraulic pressure can overcome the resistive force provided by the lower compressible element 318. As a result, the contact surface 314 of the moveable seal 204 can be forced against the lower compressive element 318 causing it to compress until forming a seal at location 320. In some examples, the upper compressible element 308 can be compressed between the chamber end plug 306 and the contact surface 312, such that the chamber end plug 306 can act as a wall against which the upper compressible element 308 is pushed. The compressible element 318 can be similarly compressed between the contact surface 314 and the bottom of the internal chamber 202 at location 320.

The upper compressible element 308 and the lower compressible element 318 can be compressed to a fully compressed length. The fully compressed length can be less than or equal to the length of the upper bump stop 310 and lower bump stop 316 respectively so that the bump stops can still contact the seals at each fluid conveyance line. For example, forming a proper seal at seal 304 can require the upper bump stop 310 to be inserted through the upper compressible element 308 and the chamber end plug 306 before reaching the seal 304. Here, the length of the upper bump stop 310 can be equal to or greater than the length of the fully compressed upper compressible element 308 in addition to the length of the chamber end plug 306. If the fully compressed length of the upper compressible element 308 is longer than the length of the upper bump stop 310, the upper bump stop 310 could not reach the seal 304, and a seal would not be formed.

The upper compressible element 308 and lower compressible element 318 can be used to position the moveable seal 204 within the internal chamber 202 in a centralized location after opening a seal or equalizing pressures of the internal chamber 202 above and below the moveable seal 204. During a sealing event, hydraulic pressure above or below the moveable seal 204 can reach a threshold point, causing a seal to be formed within the internal chamber 202. When the pressure applied by the hydraulic fluid falls below that threshold point, the seal can break, reinitiating pressure communication between fluid conveyance line 124 and fluid conveyance line 126. Implementation of the upper compressible element 308 and lower compressible element 318 can reposition the moveable seal 204 back into the center of the internal chamber 202 when the pressure differential within the internal chamber 202 and above and below the movable seal 204 falls below the threshold pressure value. For example, the pilot reset line 322 can be pressurized to cause the pressure differential above and below the moveable seal 204 within the internal chamber 202 to fall below the threshold pressure value, resulting in the upper compressible element 308 or the lower compressible element 318 to reposition the moveable seal 204. In embodiments not implementing the upper compressible element 308 and lower compressible element 318, a functional movement range of the moveable seal 204 can become off-centered even when faced with a minor fluid leak. The threshold pressure required to form a seal can be determined and preemptively designed in part by the resistive force of the upper compressible element 308 and lower compressible element 318.

The foregoing descriptions of various components related to the internal chamber 202, the fluid conveyance line 124, and the fluid conveyance line 126 can be duplicated in a similar fashion with respect to the internal chambers 328, 330, 332.

In some examples, the ingress-barrier assembly can include a pilot reset line 322 to equalize or depressurize the internal chamber 202. The pilot reset line 322 can be activated at the surface of the wellbore environment by a system or a well operator. Activating the pilot reset line 322 can reset the pressure levels on either side of the moveable seal 204 in the internal chamber 202, and for any additional chambers in the ingress-barrier assembly 120 (e.g., internal chambers 328, 330, 332). The pilot reset line 322 can be tacked or bolted to the ingress-barrier assembly 120 in a similar fashion as the fluid conveyance line 124 and the fluid conveyance line 126 (e.g., using a bolt, nut, or other non-corrosive, high-pressure-withstanding, sealable element).

The pilot reset line 322 can be formed or drilled into the ingress-barrier assembly 120 to a valve 324 (e.g., a pilot-to-open valve). The valve 324 can be located near the bottom of the internal chamber 202 with an internal port 326 drilled or formed into the ingress-barrier assembly 120 that connects to the bottom of the internal chamber 202 and the top of the internal chamber 202 such that an opening of the valve 324 is in fluid contact with the bottom of the internal chamber 202 and in fluid contact with the top of the internal chamber 202. The valve 324 can provide a mechanism (e.g., a pilot-to-open valve) to prevent high-pressure hydraulic fluids from leaking between the bottom of the internal chamber 202 and the top of the internal chamber 202 when the pilot reset line 322 is not pressurized. The opening of the valve 324 to the internal chamber 202 can be located between the bottom of the internal chamber at location 320 and the position of contact surface 314 in a sealing state (e.g., when the moveable seal 204 is sealing fluid communication to fluid conveyance line 126). For example, the valve 324 opening can be positioned within the formation of the ingress-barrier assembly 120 such that bottommost portion (e.g., contact surface 314) of the moveable seal 204 (i) does not block the flow between the bottom of the internal chamber 202 and the top of the internal chamber 202 when the internal port 326 is opened by pressure through the pilot to reset line 322 to the valve 324 and (ii) remains above the valve 324 opening. The opening of the internal port 326 to the internal chamber 202 can be located between the seal 304 and the position of the contact surface 312 in a sealing state (e.g., when the moveable seal 204 is sealing fluid communication to fluid conveyance line 124). For example, the internal port 326 opening can be positioned within the formation of the ingress-barrier assembly 120 such that the topmost portion (e.g., contact surface 312) of the moveable seal 204 (i) does not block the internal port 326 opening and (ii) remains below the internal port 326 opening).

Activating the pilot reset line 322 can involve applying pilot pressure to the valve 324. The pilot pressure can cause the valve 324 to open fluid communications between hydraulic fluids below the moveable seal 204, via a first opening of the valve 324, and above the moveable seal 204, via the internal port 326 connected to a second opening of the valve 324. Opening fluid communications between a low-pressure hydraulic fluid and a high-pressure hydraulic fluid can cause the hydraulic fluids to equalize pressures. Upon pressure equalization, the moveable seal 204 can no longer maintain the off-center location within the internal chamber 202 due to a lack of pressure differentiation on either side of the moveable seal. Without pressure differentiation between the fluid conveyance line 124 and the fluid conveyance line 126, the moveable seal 204 can be released from an off-center configuration, reinitiating fluid communications between the fluid conveyance line 124 and the fluid conveyance line 126.

In embodiments implementing a combination of the upper compressible element 308, lower compressible element 318, and pilot reset line 322, the upper compressible element 308 and the lower compressible element 318 can centralize the moveable seal 204 after the pilot reset line 322 equalizes the hydraulic fluid pressures within the internal chamber 202.

Each internal chamber of the ingress-barrier assembly can be associated with a respective valve and internal port (e.g., each of the internal chambers 202, 328, 330, 332 can have a designated valve and internal port). Activation of the pilot reset line 322 can equalize the pressures in each chamber, causing all seals to be released in each of the internal chambers 202, 328, 330, 332.

Figure 4:
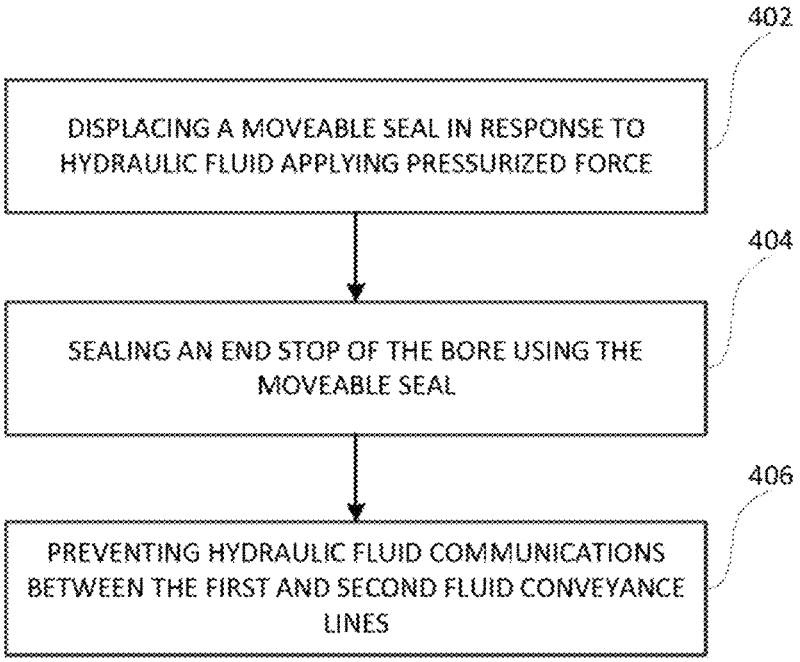
FIG. 4 is a flowchart of a process for using an ingress-barrier assembly to limit hydraulic fluid flow according to some aspects of the present disclosure.

FIG. 4 is a flowchart of a process for using an ingress-barrier assembly to limit hydraulic fluid flow according to one example. Some processes for using an ingress-barrier assembly to limit hydraulic fluid flow can be described according to previous examples. The processes described can be implemented in various wellbore environments including subsea environments. In some examples, the processes described can be implemented outside of a well.

In block 402, a moveable seal in a bore (e.g., an internal chamber) of an assembly (e.g., an ingress-barrier assembly) is displaced in response to pressurized force applied by hydraulic fluid located within the bore. The moveable seal can be used to communicate pressure between a first port and a second port. The first port can be used to communicate hydraulic fluid with a first fluid conveyance line. The second port can be used to communicate hydraulic fluid with a second fluid conveyance line. The direction of the displacement of the moveable seal can be determined by the difference in pressure between (i) hydraulic fluid located between the moveable seal and the first port and (ii) hydraulic fluid located between the moveable seal and the second port (e.g., the moveable seal can be displaced in the direction of the hydraulic fluid with lower hydraulic pressure).

In block 404, an end stop of the bore is sealed using the moveable seal. The moveable seal can seal an end stop, either a first-end stop or a second-end stop, of a bore (e.g., an internal chamber of the ingress-barrier assembly). Sealing by the moveable seal can be performed as a mechanical response to being displaced by the hydraulic fluid pressure described by block 402. The processes for sealing can be performed according to any of the preceding examples.

In block 406, the hydraulic fluid communications between the first fluid conveyance line and the second fluid conveyance line are prevented. Preventing the fluid communication between the first fluid conveyance line and the second fluid conveyance line can be executed in response to the moveable seal sealing the end stop as described by block 404. Terminating fluid communications between the first fluid conveyance line and the second fluid conveyance line with the bore of the ingress-barrier assembly can involve isolating transfer of hydraulic fluid pressure from the first fluid conveyance line to the hydraulic fluid in the second fluid conveyance line. The isolation can be performed according to any of the preceding examples.

In some aspects, systems, devices, and methods for an ingress-barrier assembly, for use with pressure-operated downhole equipment, to limit hydraulic fluid flow in a wellbore completion and operation environment are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is an assembly comprising: a first port to communicate hydraulic fluid with a first fluid conveyance line; a second port to communicate hydraulic fluid with a second fluid conveyance line; a first-end stop; a second-end stop; and a seal movable in a bore of the assembly between the first-end stop and the second-end stop to communicate pressure between the first port and the second port.

Example 2 is the assembly of example 1, further comprising: a first compressible element positionable between the moveable seal and the first-end stop for applying force to the moveable seal in response to the moveable seal moving towards the first-end stop; and a second compressible element positionable between the moveable seal and the second-end stop for applying force to the moveable seal in response to the moveable seal moving towards the second-end stop.

Example 3 is the assembly of example 2, wherein the first compressible element and the second compressible element are positionable for applying the forces to the moveable seal to align the moveable seal at a location within the assembly that is between the first port and the second port.

Example 4 is the assembly of examples 1-3, further comprising: a pilot fluid conveyance line; and a pilot-to-open valve operably connected to the first port, the second port, and the pilot fluid conveyance line, the pilot fluid conveyance line being configurable to apply pilot pressure to the pilot valve, the pilot pressure being capable of bypassing the moveable seal by communicating pressure between the first port and the second port.

Example 5 is the assembly of example 1-4, further comprising: a third port to communicate hydraulic fluid with a third fluid conveyance line; a fourth port to communicate hydraulic fluid with a fourth fluid conveyance line; a third-end stop; a fourth-end stop; and a second moveable seal movable in a second bore of the assembly between the third-end stop and the fourth-end stop to communicate pressure between the third port and the fourth port.

Example 6 is the assembly of example 1-5, wherein the moveable seal is useable to limit communication of pressure between the first port and the second port.

Example 7 is the assembly of examples 1-6, wherein the first-end stop is positionable between the second-end stop and a surface of a well, and wherein the second-end stop is positionable between the first-end stop and a bottom of the well.

Example 8 is a moveable seal comprising: a first-bump stop moveable in a bore of an assembly between a first-end stop and a location that is between a first port of the assembly and a second-bump stop of the assembly to communicate pressure between a first port of the assembly and a second port of the assembly, wherein the first port is useable to communicate hydraulic fluid with a first fluid conveyance line; and the second-bump stop moveable in the bore between the first-bump stop and a second-end stop to communicate pressure between the first port and the second port, wherein the second port is useable to communicate hydraulic fluid with a second fluid conveyance line.

Example 9 is the moveable seal of example 8, wherein a first compressible element is positionable between the moveable seal and the first-end stop for applying force to the moveable seal in response to the moveable seal moving towards the first-end stop, and wherein a second compressible element is positionable between the moveable seal and the second-end stop for applying force to the moveable seal in response to the moveable seal moving towards the second-end stop.

Example 10 is the moveable seal of example 9, wherein the first compressible element and the second compressible element are positionable for applying the forces to the moveable seal to align the moveable seal at a location within the assembly that is between the first port and the second port.

Example 11 is the moveable seal of example 8-10, wherein a pilot valve is operably connected to the first port, the second port, and a pilot fluid conveyance line, the pilot fluid conveyance line being configurable to apply pilot pressure to the pilot valve, the pilot pressure being capable of bypassing the moveable seal by communicating pressure between the first port and the second port.

Example 12 is the moveable seal of examples 8-11, wherein the moveable seal is useable to limit communication of pressure between the first port and the second port.

Example 13 is the moveable seal of example 8-12, wherein the first-end stop is positionable between the second-end stop and a surface of a well, and wherein the second-end stop is positionable between the first-end stop and a bottom of the well.

Example 14 is a method comprising: displacing, in response to pressurized force applied by hydraulic fluid, a moveable seal in a bore of an assembly to communicate pressure between a first port and a second port, the first port being used to communicate hydraulic fluid with a first fluid conveyance line, the second port being used to communicate hydraulic fluid with a second fluid conveyance line; sealing, in response to displacing the moveable seal, an end stop of the bore with the moveable seal; and preventing, in response to sealing the end stop, hydraulic fluid communications between the first fluid conveyance line and the second fluid conveyance line.

Example 15 is the method of example 14, the method further comprising: applying force, by a first compressible element, to the moveable seal in response to the moveable seal being displaced towards the first port, the first compressible element being positioned between the moveable seal and the first port; and applying force, by a second compressible element, to the moveable seal in response to the moveable seal being displaced towards the second port, the second compressible element being positioned between the moveable seal and the second port.

Example 16 is the method of example 15, the method further comprising: aligning, in response to the force applied to the moveable seal by the first compressible element and the second compressible element, the moveable seal at a location within the assembly that is between the first port and the second port.

Example 17 is the method of examples 14-16, the method further comprising: pressurizing a pilot fluid conveyance line, wherein the pilot fluid conveyance line is connected to a pilot valve, and wherein the pilot valve is connected to the first port and the second port; and communicating, in response to pressurizing the pilot fluid conveyance line, pressure between the first port and the second port, wherein fluid communication between the first port and the second port bypasses the moveable seal.

Example 18 is the method of examples 14-17, the method further comprising: displacing, in response to pressurized force applied by hydraulic fluid, a second moveable seal in a second bore of the assembly to communicate pressure between a third port and a fourth port, the third port being used to communicate hydraulic fluid with a third fluid conveyance line, the fourth port being used to communicate hydraulic fluid with a fourth fluid conveyance line; sealing, in response to displacing the moveable seal, an end stop of the second bore with the second moveable seal; and preventing, in response to sealing the end stop of the second bore, hydraulic fluid communications between the third fluid conveyance line and the fourth fluid conveyance line.

Example 19 is the method of examples 14-18, where the moveable seal is used to limit communication of pressure between the first port and the second port.

Example 20 is the method of examples 14-19, wherein a displacement direction of the moveable seal is determined by a difference in pressure between (i) hydraulic fluid located between the moveable seal and the first port and (ii) hydraulic fluid located between the moveable seal and the second port, the moveable seal being displaced towards a direction of the hydraulic fluid with lower pressure.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

a first port to communicate hydraulic fluid with a first fluid conveyance line;

a second port to communicate hydraulic fluid with a second fluid conveyance line;

a first-end stop proximate a first end of a bore of the assembly;

a second-end stop proximate a second end of the bore;

a seal moveable in the bore of the assembly between the first-end stop and the second-end stop to communicate pressure between the first port and the second port;

a pilot fluid conveyance line; and a pilot-to-open valve operably connected to the first port, the second port, and the pilot fluid conveyance line, the pilot fluid conveyance line being configurable to apply pilot pressure to the pilot valve, the pilot pressure being capable of bypassing the seal by communicating pressure between the first port and the second port.

2. The assembly of claim 1, further comprising:

a first compressible element positionable between the seal and the first-end stop for applying force to the seal in response to the seal moving towards the first-end stop; and a second compressible element positionable between the seal and the second-end stop for applying force to the seal in response to the seal moving towards the second-end stop.

3. The assembly of claim 2, wherein the first compressible element and the second compressible element are positionable for applying the forces to the seal to align the seal at a location within the assembly that is between the first port and the second port.

4. The assembly of claim 1, further comprising:

a third port to communicate hydraulic fluid with a third fluid conveyance line;

a fourth port to communicate hydraulic fluid with a fourth fluid conveyance line;

a third-end stop;

a fourth-end stop; and a second seal movable in a second bore of the assembly between the third-end stop and the fourth-end stop to communicate pressure between the third port and the fourth port.

5. The assembly of claim 1, wherein the seal is useable to limit communication of pressure between the first port and the second port.

6. The assembly of claim 1, wherein the first-end stop is positionable between the second-end stop and a surface of a well, and wherein the second-end stop is positionable between the first-end stop and a bottom of the well.

7. A moveable seal comprising:

a first-bump stop moveable in a bore of an assembly between a first-end stop proximate a first end of the bore and a location that is between a first port of the assembly and a second-bump stop of the assembly to communicate pressure between the first port of the assembly and a second port of the assembly, wherein the first port is useable to communicate hydraulic fluid with a first fluid conveyance line; and the second-bump stop moveable in the bore between the first-bump stop and a second-end stop proximate a second end of the bore to communicate pressure between the first port and the second port, wherein the second port is useable to communicate hydraulic fluid with a second fluid conveyance line, wherein a first compressible element is positionable between the moveable seal and the first-end stop for applying force to the moveable seal in response to the moveable seal moving towards the first-end stop, and wherein a second compressible element is positionable between the moveable seal and the second-end stop for applying force to the moveable seal in response to the moveable seal moving towards the second-end stop.

8. The moveable seal of claim 7, wherein the first compressible element and the second compressible element are positionable for applying the forces to the moveable seal to align the moveable seal at a location within the assembly that is between the first port and the second port.

9. The moveable seal of claim 7, wherein a pilot valve is operably connected to the first port, the second port, and a pilot fluid conveyance line, the pilot fluid conveyance line being configurable to apply pilot pressure to the pilot valve, the pilot pressure being capable of by passing the moveable seal by communicating pressure between the first port and the second port.

10. The moveable seal of claim 7, wherein the moveable seal is useable to limit communication of pressure between the first port and the second port.

11. The moveable seal of claim 7, wherein the first-end stop is positionable between the second-end stop and a surface of a well, and wherein the second-end stop is positionable between the first-end stop and a bottom of the well.

12. A method comprising:

displacing, in response to pressurized force applied by hydraulic fluid, a moveable seal in a bore of an assembly to communicate pressure between a first port and a second port, the first port being used to communicate hydraulic fluid with a first fluid conveyance line, the second port being used to communicate hydraulic fluid with a second fluid conveyance line;

sealing, in response to displacing the moveable seal, an end stop proximate a first end or a second end of the bore with the moveable seal;

preventing, in response to sealing the end stop, hydraulic fluid communications between the first fluid conveyance line and the second fluid conveyance line;

pressurizing a pilot fluid conveyance line, wherein the pilot fluid conveyance line is connected to a pilot valve, and wherein the pilot valve is connected to the first port and the second port; and communicating, in response to pressurizing the pilot fluid conveyance line, pressure between the first port and the second port, wherein fluid communication between the first port and the second port bypasses the moveable seal.

13. The method of claim 12, the method further comprising:

applying force, by a first compressible element, to the moveable seal in response to the moveable seal being displaced towards the first port, the first compressible element being positioned between the moveable seal and the first port; and applying force, by a second compressible element, to the moveable seal in response to the moveable seal being displaced towards the second port, the second compressible element being positioned between the moveable seal and the second port.

14. The method of claim 13, the method further comprising:

aligning, in response to the force applied to the moveable seal by the first compressible element and the second compressible element, the moveable seal at a location within the assembly that is between the first port and the second port.

15. The method of claim 12, the method further comprising:

displacing, in response to pressurized force applied by hydraulic fluid, a second moveable seal in a second bore of the assembly to communicate pressure between a third port and a fourth port, the third port being used to communicate hydraulic fluid with a third fluid conveyance line, the fourth port being used to communicate hydraulic fluid with a fourth fluid conveyance line;

sealing, in response to displacing the second moveable seal, an end stop of the second bore with the second moveable seal; and preventing, in response to sealing the end stop of the second bore, hydraulic fluid communications between the third fluid conveyance line and the fourth fluid conveyance line.

16. The method of claim 12, where the moveable seal is used to limit communication of pressure between the first port and the second port.

17. The method of claim 12, wherein a displacement direction of the moveable seal is determined by a difference in pressure between (i) hydraulic fluid located between the moveable seal and the first port and (ii) hydraulic fluid located between the moveable seal and the second port, the moveable seal being displaced towards a direction of the hydraulic fluid with lower pressure.

18. An assembly comprising:

a first port to communicate hydraulic fluid with a first fluid conveyance line;

a second port to communicate hydraulic fluid with a second fluid conveyance line;

a first-end stop proximate a first end of a bore of the assembly;

a second-end stop proximate a second end of the bore;

a seal moveable in the bore of the assembly between the first-end stop and the second-end stop to communicate pressure between the first port and the second port;

a first compressible element positionable between the seal and the first-end stop for applying force to the seal in response to the seal moving towards the first-end stop; and a second compressible element positionable between the seal and the second-end stop for applying force to the seal in response to the seal moving towards the second-end stop.

19. The assembly of claim 18, further comprising:

a first compressible element positionable between the seal and the first-end stop for applying force to the seal in response to the seal moving towards the first-end stop; and a second compressible element positionable between the seal and the second-end stop for applying force to the seal in response to the seal moving towards the second-end stop.

20. The assembly of claim 18, wherein the first compressible element and the second compressible element are positionable for applying the forces to the seal to align the seal at a location within the assembly that is between the first port and the second port.

21. The assembly of claim 18, further comprising:

a pilot fluid conveyance line; and a pilot-to-open valve operably connected to the first port, the second port, and the pilot fluid conveyance line, the pilot fluid conveyance line being configurable to apply pilot pressure to the pilot valve, the pilot pressure being capable of bypassing the seal by communicating pressure between the first port and the second port.

22. The assembly of claim 18, further comprising:

a third port to communicate hydraulic fluid with a third fluid conveyance line;

a fourth port to communicate hydraulic fluid with a fourth fluid conveyance line;

a third-end stop;

a fourth-end stop; and a second seal movable in a second bore of the assembly between the third-end stop and the fourth-end stop to communicate pressure between the third port and the fourth port.

23. The assembly of claim 18, wherein the seal is useable to limit communication of pressure between the first port and the second port.

24. The assembly of claim 18, wherein the first-end stop is positionable between the second-end stop and a surface of a well, and wherein the second-end stop is positionable between the first-end stop and a bottom of the well.

* * * * *